US010807110B2

(12) United States Patent
Herre et al.

(10) Patent No.: US 10,807,110 B2
(45) Date of Patent: Oct. 20, 2020

(54) APPLICATOR, IN PARTICULAR ROTARY ATOMISER

(71) Applicant: Dürr Systems AG, Bietigheim-Bissingen (DE)

(72) Inventors: Frank Herre, Oberriexingen (DE); Manfred Michelfelder, Höpfigheim/Steinheim (DE); Michael Baumann, Flein (DE); Sascha Hermann, Korb (DE); Bernhard Seiz, Lauffen (DE); Thomas Buck, Sachsenheim (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 122 days.

(21) Appl. No.: 15/738,584

(22) PCT Filed: Jul. 1, 2016

(86) PCT No.: PCT/EP2016/001126
§ 371 (c)(1),
(2) Date: Dec. 21, 2017

(87) PCT Pub. No.: WO2017/005353
PCT Pub. Date: Jan. 12, 2017

(65) Prior Publication Data

US 2018/0185860 A1 Jul. 5, 2018

(30) Foreign Application Priority Data

Jul. 3, 2015 (DE) ..... 10 2015 008 658
Aug. 5, 2015 (DE) ..... 10 2015 010 158

(51) Int. Cl.
*B05B 7/04* (2006.01)
*B05B 15/55* (2018.01)
(Continued)

(52) U.S. Cl.
CPC ..... *B05B 7/0408* (2013.01); *B05B 1/3006* (2013.01); *B05B 1/306* (2013.01);
(Continued)

(58) Field of Classification Search
CPC ..... B05B 15/55; B05B 1/3006; B05B 1/306; B05B 12/087; B05B 7/408; B05B 3/1014
See application file for complete search history.

(56) References Cited

U.S. PATENT DOCUMENTS 4,509,684 A 4/1985 Schowiak
4,957,782 A 9/1990 Medler et al.
(Continued)

FOREIGN PATENT DOCUMENTS

CN 2551350 Y 5/2003
CN 202182220 U 4/2012
(Continued)

OTHER PUBLICATIONS

International Search Report and Written Opinion for PCT/EP2016/001126 dated Nov. 11, 2016 (with English translation; 16 pages).
(Continued)

*Primary Examiner* — Umashankar Venkatesan
(74) *Attorney, Agent, or Firm* — Bejin Bieneman PLC

(57) ABSTRACT

The disclosure relates to an applicator (RZ), in particular a rotary atomizer, for the application of a coating agent, in particular a two-component paint, comprising a first coating agent connection (SL) for feeding a first coating agent, in particular a basic resin of a two-component paint, a first coating agent strand (L1-L4), which extends in the applicator (RZ) from the first coating agent connection (SL) and carries the first coating agent, and a first valve (SLV1), which is arranged in the first coating agent strand (L1-L4) and controls the flow of the first coating agent, wherein the first valve (SLV1) can be controlled by a first control signal.
(Continued)

It is proposed that a first pressure-relief valve (SLV1), which is actuated by its own medium, is arranged in the first coating agent strand (L1-L4) and, to avoid a problem being caused by excessive pressure, opens automatically when the pressure upstream of the first pressure-relief valve (SLV1) exceeds a certain maximum pressure.

17 Claims, 7 Drawing Sheets

(51) Int. Cl.
*B05B 1/30* (2006.01)
*B05B 12/08* (2006.01)
*B05B 3/10* (2006.01)

(52) U.S. Cl.
CPC ..... *B05B 12/087* (2013.01); *B05B 15/55* (2018.02); *B05B 3/1014* (2013.01)

(56) References Cited

U.S. PATENT DOCUMENTS

| | | | |
|---|---|---|---|
| 8,875,647 | B2 | 11/2014 | Herre |
| 8,881,757 | B2 | 11/2014 | Melcher |
| 9,346,070 | B2 | 5/2016 | Herre |
| 9,539,594 | B2 | 1/2017 | Seiz et al. |
| 9,604,244 | B2 | 3/2017 | Herre |
| 9,782,786 | B2 | 10/2017 | Melcher et al. |
| 2008/0173728 | A1 | 7/2008 | Whewell et al. |

FOREIGN PATENT DOCUMENTS

| | | | |
|---|---|---|---|
| CN | 202209455 | U | 5/2012 |
| CN | 202270502 | U | 6/2012 |
| CN | 203540814 | U | 4/2014 |
| CN | 104174524 | A | 12/2014 |
| CN | 204422196 | U | 6/2015 |
| DE | 2747707 | A1 | 4/1979 |
| DE | 8131967 | U1 | 4/1983 |
| DE | 3415253 | A1 | 10/1985 |
| DE | 3713999 | A1 | 11/1988 |
| DE | 29719535 | U1 | 2/1998 |
| DE | 102006053921 | A1 | 5/2008 |
| DE | 102007037663 | A1 | 2/2009 |
| DE | 102008015258 | A1 | 9/2009 |
| DE | 102008037035 | A1 | 2/2010 |
| DE | 102009020064 | A1 | 11/2010 |
| DE | 102009031180 | A1 | 12/2010 |
| DE | 102010019771 | A1 | 11/2011 |
| DE | 102013002412 | A1 | 8/2014 |
| EP | 0141930 | B1 | 1/1989 |
| EP | 1502657 | A2 | 2/2005 |
| EP | 2990124 | A1 | 3/2016 |
| JP | 2001104849 | A | 4/2001 |
| RU | 249919 | C2 | 9/2011 |
| WO | 8401312 | A1 | 4/1984 |

OTHER PUBLICATIONS

CIPO Office Action for Application No. 201680039565.8 dated Sep. 19, 2019 (19 pages; with English translation).
JPO Office Action for Application No. JP2018-500327 dated Jul. 21, 2020 (9 pages; with English translation).

APPLICATOR, IN PARTICULAR ROTARY ATOMISER

CROSS-REFERENCE TO RELATED APPLICATIONS

This application is a national stage of, and claims priority to, Patent Cooperation Treaty Application No. PCT/EP2016/001126, filed on Jul. 1, 2016, which application claims priority to German Application No. DE 10 2015 008 658.8, filed on Jul. 3, 2015, and to German Application No. DE10 2015 010 158.7, filed on Aug. 5, 2015, which applications are hereby incorporated herein by reference in their entireties.

The disclosure relates to an applicator, in particular a rotary atomiser, for applying a coating agent.

BACKGROUND

Two-component paints (2K paints) which consist of two components, namely a curing agent (e.g. isocyanate) and a parent paint, are known from the prior art. When such 2K paints are conveyed in a painting system, needle valves which have a displaceable valve needle are conventionally used as shut-off valves. The valve needle hereby extends through a valve chamber which during operation is filled with the 2K paint, the valve chamber being sealed with respect to the valve drive acting upon the valve needle by a sealing ring. The sealing ring slides with its inner side against the outer lateral surface of the valve needle and rests with its outer periphery on the inside wall of the valve chamber.

A problem here is the fact that the curing agent (e.g. isocyanate) generally reacts with water and then cures. Even extremely small amounts of water are sufficient to start the curing process, so that, for example, even normal atmospheric moisture leads to curing. This is a problem because the 2K paint or the curing agent used has very good creep properties and is of low viscosity and is therefore able to migrate beneath the sealing ring around the valve needle, so that the 2K paint or the curing agent can escape from the valve chamber filled with paint into the region of the valve drive. In particular in the case of relatively long stoppage times (e.g. at weekends), this can lead to undesired curing of the 2K paint or of the curing agent. For example, the cured 2K paint can stick the valve needle in the valve seat. In addition, the 2K paint can adhere to the valve needle and then, in the cured state, damage the surrounding sealing ring, which results in leakage. Furthermore, cured deposits in the valve seat can result in the valve no longer closing. Cured deposits can also have the result that the valve closes more slowly.

A valve failure is particularly problematic if the valve is no longer able to open, since there may then be an overpressure fault upstream of the valve, which in an extreme case can lead to bursting of the feed hoses so that 2K paint or curing agent can escape, which then involves considerable stoppage times for cleaning and repair work.

Finally, a chemical reaction can occur in the region of the needle tip between the medium (2K paint or curing agent) and the material of the needle tip or of the valve seat, which can likewise lead to adhesion so that the valve is no longer able to open.

DETAILED DESCRIPTION

Figure 1:
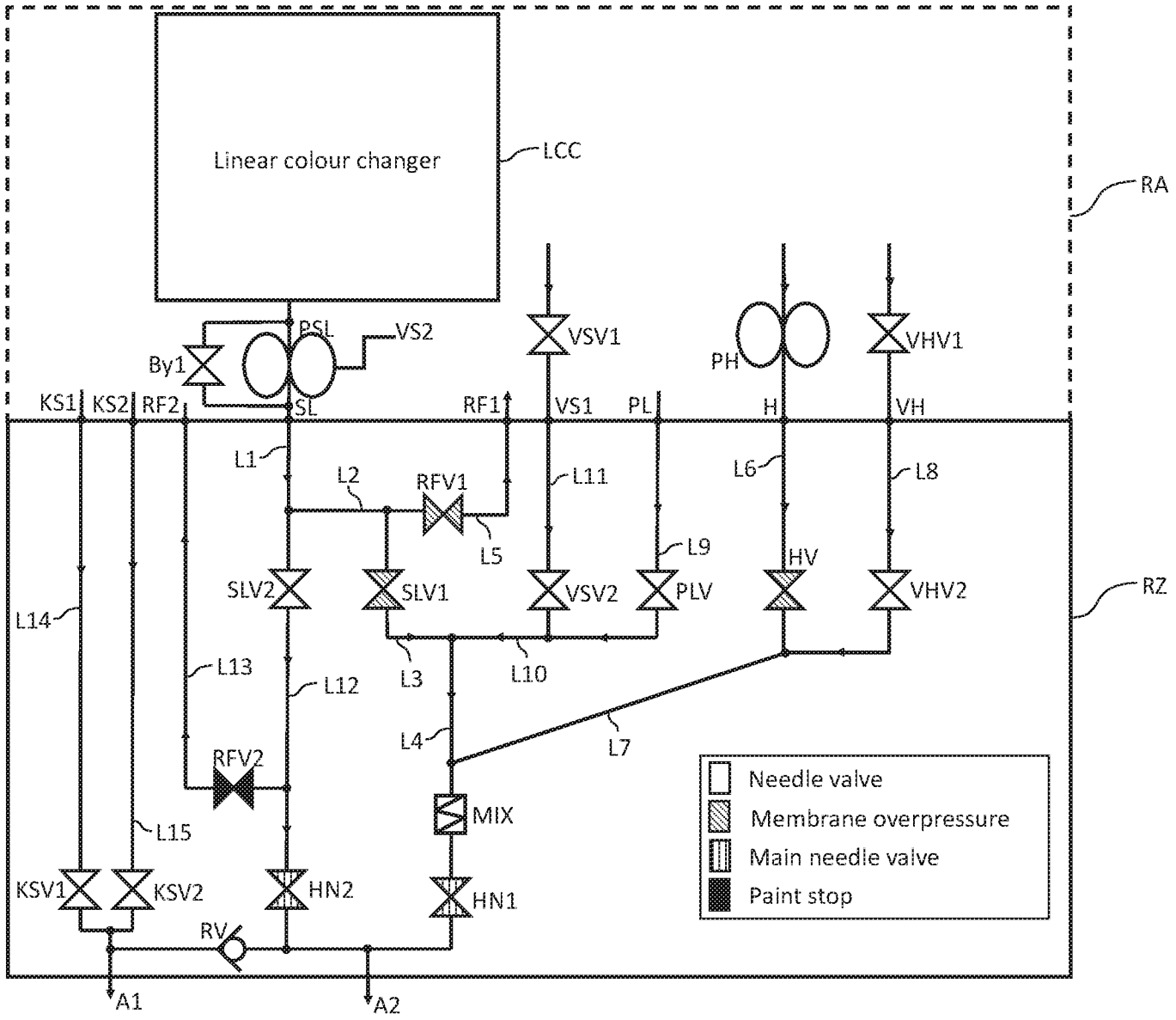
FIG. 1 is a fluid schematic diagram of a rotary atomiser according to the disclosure on a painting robot.

The applicator (e.g. rotary atomiser) according to the disclosure firstly has, in conformity with the prior art, a first coating agent connection via which a first coating agent can be supplied, such as, for example, a parent paint of a two-component paint (2K paint).

It should be mentioned here that the term applicator used within the context of the disclosure is not limited to the preferred embodiment of a rotary atomiser, wherein such rotary atomisers can have as the spray element a rotating bell cup or a rotating disc. Other possible embodiments of applicators according to the disclosure are air atomisers, strip atomisers (e.g. according to DE 10 2013 002 412 A1), manual spray guns, disc atomisers, airless atomisers, airmix atomisers and ultrasonic atomisers, to name only a few examples.

It should further be mentioned that the disclosure is not limited in terms of the applied coating agent to paints or paint constituents. The coating agent can in fact also be other fluids, such as, for example, sealing compositions, insulating material or adhesive, to name only a few examples.

In this connection it should also be mentioned that the disclosure is not limited to one-component coating agents or two-component coating agents but can also be used with multi-component coating agents which can have, for example, three components.

The applicator according to the disclosure additionally has a first coating agent line which in the applicator leads from the first coating agent connection and guides the first coating agent.

In this first coating agent line there is arranged a controllable first valve which controls the flow of the first coating agent through the first coating agent line, this first valve being controllable by a first control signal.

The control signal can be, for example, an electrical control signal or a pneumatic control signal, but the disclosure is not limited to these examples with regard to the control of the valves.

The applicator according to the disclosure is distinguished over the prior art in that there is arranged in the first coating agent line an own-medium-actuated first overpressure valve which, in order to avoid an overpressure fault, which opens automatically when the pressure upstream of the first overpressure valve exceeds a specific maximum pressure. Thus, if an overpressure fault occurs in the first coating agent line because a valve in the first coating agent line fails and no longer opens, bursting of the feed lines is prevented because the first overpressure valve then opens automatically. The first overpressure valve is thus an own-medium-actuated overpressure valve which opens or closes in dependence upon the fluid pressure present on the inlet side.

All the fluid lines in the applicator that are at risk of overpressure are preferably secured by such overpressure valves in order to allow a reduction in pressure in the case of overpressure faults. This can include all the fluid lines in the applicator, for example for parent paint, curing agent, ready mixed two-component paint, one-component paint, solvent (flushing agent).

In one example, the first overpressure valve is formed by the controllable first valve. This means that the first valve performs two functions. On the one hand, the first valve allows the flow of fluid through the first coating agent line to be controlled. On the other hand, however, the first valve also acts as an overpressure valve and opens automatically (own-medium-actuated) when the pressure present on the inlet side exceeds a specific maximum pressure.

In one example, the first coating agent line leads to an application element, which applies the first coating agent. For example, this application element can be a bell cup, or a paint nozzle in a bell cup, but the disclosure is not limited to this example as regards the type of application element.

In the first coating agent line, between the first overpressure valve and the application element, there is arranged a first main valve, which either blocks or enables the flow of fluid in the first coating agent line. The first main valve is preferably in the form of a main needle valve and has a displaceable valve needle which either frees or blocks a valve seat. Such needle valves are known per se from the prior art and therefore do not have to be described in greater detail.

In one example, the applicator has a second coating agent connection for supplying a second coating agent, such as, for example, a curing agent of the 2K paint. A second coating agent line then leads from this second coating agent connection, there being arranged in the second coating agent line a second overpressure valve which is likewise own-medium-actuated and opens automatically when the pressure upstream of the first overpressure valve exceeds a specific maximum pressure. The second coating agent line preferably joins the first coating agent line upstream of the first main valve, which allows the parent paint to be mixed with the curing agent.

A mixer is therefore preferably arranged in the first coating agent line between the point at which the second coating agent line joins and the first main valve, which mixer mixes the parent paint with the curing agent to form the 2K paint.

The mixer is preferably in the form of a static mixer, for example in the form of a lattice mixer or a helical mixer. Such mixers are known from DE 10 2010 019 771 A1, for example, so that the content of that publication is to be incorporated in its entirety into the present description in respect of the construction and functioning of the mixer.

In addition, the applicator according to the disclosure preferably has a first return connection for returning fluids (e.g. residues of the parent paint) into a first return system. A first return line, which opens into the first return connection, branches from the first coating agent line upstream of the first overpressure valve. In the first return line there is preferably arranged a third overpressure valve, which is likewise own-medium-actuated and opens automatically when the pressure in the first return line upstream of the third overpressure valve exceeds a specific maximum value.

Furthermore, the applicator according to the disclosure preferably has a first solvent connection for supplying a first solvent, the first solvent preferably being provided for the parent paint. A first solvent line preferably leads from this first solvent connection, the first solvent line preferably joining the first coating agent line between the first overpressure valve and the first main valve. A first solvent valve, which is controllable and enables or blocks the flow of solvent, is preferably arranged in the first solvent line.

In addition, the applicator according to the disclosure may have a pulsed air connection for supplying pulsed air for cleaning purposes, which is known per se from the prior art. A pulsed air line preferably leads from this pulsed air connection, which pulsed air line joins the first coating agent line, between the first overpressure valve and the first main valve, it being possible for a pulsed air valve to be arranged in the pulsed air line for controlling the pulsed air.

Furthermore, the applicator according to the disclosure may comprises a second solvent connection for supplying a second solvent, which is preferably provided for the curing agent. A second solvent line preferably leads from this second solvent connection, which second solvent line joins the first coating agent line between the first overpressure valve and the first main valve, a second solvent valve preferably being arranged in the second solvent line. This second solvent valve is preferably controllable in order to either enable or block the flow of solvent.

In the applicator according to the disclosure, a third coating agent line may also lead from the first coating agent connection, it being possible for a second main valve, in particular in the form of a main needle valve, to be arranged in the third coating agent line, which is known per se from the prior art and therefore does not have to be described in greater detail. The first main valve and the second main valve are preferably brought together on the outlet side and lead to the application element (e.g. bell cup). In this construction, the applicator can thus be used either for the application of a one-component paint or for the application of a two-component paint.

Furthermore, the applicator according to the disclosure may have a second return connection for returning fluids (e.g. pulsed air, paint foam) to a second return system. There then branches from the third coating agent line, preferably upstream of the second main valve, a second return line, which opens into the second return connection, a return valve preferably being arranged in this second return line. This return valve is preferably own-medium-actuated, the return valve preferably distinguishing, by virtue of its design, between liquid coating agent at the inlet, on the one hand, and compressed air or foam at the inlet, on the other hand. The return valve then opens automatically when compressed air or foam is present at the inlet of the return valve. On the other hand, the return valve closes when liquid coating agent is present at the inlet of the return valve. The return valve can therefore also be referred to as a paint stop valve, since it closes automatically when liquid paint is present at the inlet of the return valve instead of compressed air or foam. The construction and functioning of such a paint stop valve are described in detail in U.S. Pat. No. 8,881,757 B2 and U.S. Pat. No. 9,782,786 B2, so that the content of that publication is to be incorporated in its entirety into the present description in respect of the construction and functioning of the return valve (paint stop valve).

In addition, the applicator according to the disclosure may have at least one short-flush connection for supplying a flushing medium for short flushing of the applicator. There then leads from the short-flush connection at least one short-flush line, which can guide the flushing medium to the application element while bypassing the coating agent lines.

There is preferably arranged in the short-flush line a controllable short-flush valve, which either enables or blocks the flow of flushing medium.

It should further be mentioned that the overpressure valves in the open state may have a pressure-surge-damping function, so that pressure surges entering on the inlet side are transmitted on the outlet side only in damped form. This can be achieved, for example, by configuring the overpressure valves as membrane valves, as will be described in greater detail below.

The disclosure also involves the technical teaching that the overpressure valve is a specific needle valve. The needle valve according to the disclosure first has a valve seat and a displaceable valve needle having a needle stem and a needle head. The valve needle is displaceable between a closed position and an open position. In the closed position, the needle head of the valve needle closes the valve seat and thereby blocks the flow of fluid. In the open position, on the other hand, the valve needle is lifted from the needle head and thereby enables the flow of fluid.

In a variant of the disclosure, various intermediate positions of the valve needle can continuously be set between the open position and the closed position, in order to control the flow of fluid not only qualitatively (open/closed) but also quantitatively, that is to say with an adjustable flow resistance. In another variant of the disclosure, on the other hand, the needle valve controls the flow of fluid only qualitatively, the flow of fluid being either enabled or blocked.

The disclosure provides that the valve chamber, which surrounds the valve needle and during operation is filled with media, is sealed by a flexible membrane which surrounds the valve needle upstream of the needle head in an annular and sealing manner. The flexible membrane reliably prevents coating agent (e.g. curing agent) from escaping from the valve chamber filled with media in the direction towards the valve drive and curing there.

In one example, the valve needle is displaceably arranged in the valve chamber, the valve chamber being cylindrical at least in part. The membrane then rests at its centre, preferably in a sealing manner, against the needle stem of the valve needle and is fixed to the needle stem of the valve needle. This means that the membrane does not slide against the valve needle but performs the movement of displacement of the valve needle between the open position and the closed position. This means that a displacement of the valve needle leads to a corresponding axial deflection of the membrane. Conversely, an axial deflection of the membrane, for example as a result of pressure acting upon one side of the membrane, also leads to a corresponding displacement of the valve needle. At its peripheral edge, on the other hand, the membrane is fixed in a sealing manner to the inside wall of the valve chamber. The membrane thus permits, at the centre, an axial stroke which is at least as great as the axial distance between the closed position and the open position of the valve needle, so that the membrane does not impede the movement of the valve needle.

In one example, the needle valve has a valve drive for displacing the valve needle, wherein the valve drive can be in the form of a pneumatic valve drive having a piston, for example, which is known per se from the prior art and therefore does not have to be described in greater detail.

In addition, the needle valve according to the disclosure preferably has a coating agent inlet for supplying the coating agent (e.g. 2K paint or curing agent), wherein the coating agent inlet preferably opens into the valve chamber on the side of the membrane remote from the valve drive, so that the membrane seals the valve drive with respect to the valve chamber filled with coating agent.

The needle valve according to the disclosure may have a coating agent outlet for discharging the coating agent, wherein the coating agent outlet may open into the valve seat so that the coating agent is able to flow through the valve seat to the coating agent outlet when the valve needle is in the open position.

It has already been mentioned above that the needle valve according to the disclosure can have a valve drive for displacing the valve needle. In one example, the valve drive comprises a displaceable piston which acts upon the valve needle in order to displace the valve needle. The piston may be driven pneumatically. To that end, the needle valve preferably has a control air inlet for supplying control air, wherein the control air acts upon the piston in order to displace the piston and thus also the valve needle.

The needle valve according to the disclosure may comprise a valve spring which acts with a spring force upon the piston or the valve needle. The valve spring on the one hand and the control air on the other hand act in opposite directions.

It should further be mentioned that the spring force of the valve spring is preferably at least 20 N, 40 N or at least 80 N and/or not more than 400 N, 200 N or 100 N, which preferably applies both to the closed position and to the open position of the valve spring.

In one example, the valve spring pushes the valve needle in the direction towards the closed position, whereas the control air pushes the valve needle, via the piston, in the direction towards the open position. The valve spring and the needle head are preferably arranged on opposite sides of the piston.

It should be mentioned here that the piston may have a relatively large piston diameter in order to generate as great an opening force as possible when moving the valve needle into the open position. It should thereby be considered that the opening force is dependent upon the effective piston area and thus also upon the piston diameter and upon the pneumatic pressure of the control air. The piston therefore preferably has a piston diameter of at least 5 mm, 10 mm, 15 mm, 20 mm, 25 mm or even 32 mm. The piston diameter is sufficiently large that a sufficiently great opening force can be produced with a conventional control air pressure of less than 6 bar. This is expedient because conventional 6-bar compressed air networks are already available in most painting systems and can then also be used to actuate the needle valve according to the disclosure. In this manner, a separate compressed air network for actuating the needle valve is thus not required.

It has already been mentioned above that the valve spring pushes the valve needle in the direction towards the closed position, namely with a specific closing force. The pneumatic valve drive, on the other hand, when pneumatically actuated, pushes the valve needle in the direction towards the open position with a specific opening force. The opening force of the pneumatic valve drive should thereby be greater than the closing force by a specific opening force excess so that the needle valve can reliably be opened if the needle head is adhered to the valve seat. The needle valve is therefore so designed that the opening force excess is greater than 20 N, 40 N, 60 N, 80 N, 100 N, 120 N, 130 N or even 180 N.

In the description of the prior art, mention has already been made at the beginning of the risk that the coating agent hoses may burst upstream of the needle valve in the case of an overpressure fault also as a result of incorrect operation or misinterpretation of the overpressure fault, as a result of which 2K paint or curing agent can escape, which then leads to longer stoppage times because the 2K paint or curing agent which has escaped cures. After bursting, there is no further overpressure fault. When the operators start the plant up again, a portion or a large part of the paint escapes from the burst hose and floods, for example, the entire hand axis region. In most cases, the fault is only discovered when several litres have already escaped and other further faults occur, for example speed fault, since the turbine waste air is no longer able to escape due to the paint. The needle valve according to the disclosure therefore may have an overpressure function which leads to automatic opening of the valve if a specific opening pressure at the coating agent inlet is exceeded. To that end, the coating agent present in the valve chamber pushes against the membrane, whereby the membrane and thus also the valve needle is pushed out of the closed position into the open position if the coating agent pressure is sufficiently great to overcome the oppositely directed force of the valve spring. The membrane therefore may have a membrane diameter of at least 3 mm, 6 mm or 9 mm and/or not more than 40 mm, 20 mm or 11 mm. The opening pressure of the coating agent at the coating agent inlet is then preferably at least 8 bar, 10 bar, 12 bar, 14 bar or at least 38 bar and/or not more than 38 bar, 22 bar, 18 bar or 16 bar. The closing force of the spring must thus be so adapted to the desired opening pressure and the effective cross-section of the membrane that the coating agent pressure in the valve chamber pushes the membrane and thus also the valve needle out of the closed position into the open position when the desired opening pressure is exceeded.

It should further be mentioned that the valve seat may narrow in the direction of flow with a specific seat angle, just as the needle head also preferably narrows in the direction of flow with a specific head angle. In one example, the seat angle is substantially equal to the head angle. For example, the seat angle can be in the range of from 35° to 50°, just as the head angle is also preferably in the range of from 35° to 50°, which ensures optimal sealing. A larger head angle improves the flow of the medium in the needle valves according to the disclosure having an additional membrane, in which the needle strokes are small (about 1.5 mm instead of 3 mm in conventional needle valves).

In one example, an additional sealing element is installed in the needle head of the valve needle in order to seal the valve seat in the closed position. This additional sealing element can be made of a different material than the needle head of the valve needle, preference being given to the use of a resilient material, such as, for example, FFKM (perfluoro-elastomers). For example, the additional sealing element can be moulded onto the needle head. However, it is also possible that the sealing element is installed in the needle head, for example in an annular groove in the needle head. The needle head itself can be made, for example, of titanium or of a titanium alloy, in order that the needle head is resistant to chemically aggressive curing agents of 2K paints.

It has already been mentioned briefly above that the needle head and the valve seat preferably taper substantially conically in the direction of flow. The needle head can have an annular groove in which the sealing element, which has already been mentioned briefly above, can be installed. The problem can thereby arise that the closing force acting upon the valve needle is absorbed completely by the sealing element, which can then lead to mechanical overloading of and damage to the sealing element. This can be prevented if the needle head has a rigid stop and rests in the closed position with the stop on the valve seat. When the valve closes, the sealing element in the needle head is thus subjected to pressure only until the valve needle rests with its stop on the valve seat. In this manner, compression of the sealing element in the needle head as the valve closes is limited, which is beneficial for the life of the sealing element.

In the preferred embodiment of the disclosure, this stop is formed by an annular peripheral supporting surface which is located in the conical lateral surface of the needle head upstream of the sealing element. This can lead to the problem that the sealing element seals the region of the needle head downstream of the sealing element, so that this region cannot be reached by the flushing medium in a flushing operation. This problem can be solved within the context of the disclosure if the supporting surface has at least one flushing groove running axially, through which flushing medium from the valve chamber can enter the region downstream of the sealing element in the axial direction. For example, such a flushing groove can have a groove width of from 1 mm to 2 mm.

Within the context of the disclosure, it is possible that the flexible membrane sealing the valve chamber replaces the sealing ring that is present in conventional needle valves. However, it is also possible within the context of the disclosure that a conventional sealing ring which surrounds the valve needle in an annular manner and rests in a sliding manner on the lateral surface of the valve needle is also present in addition to the flexible membrane for sealing.

The needle stem of the valve needle may have a diameter which can be in the range of from 2 mm to 10 mm, from 3 mm to 6 mm or from 4 mm to 5 mm. The maximum needle stroke of the valve needle, on the other hand, is preferably less than 3 mm, 2.5 mm, 2 mm or even less than 1.6 mm.

Different variants are possible within the context of the disclosure, which differ in the number of different coating agent lines within the applicator.

A first variant of the disclosure in which two coating agent lines extend within the applicator has already been described above. One coating agent line is thereby reserved for a curing agent of a two-component paint. The other coating agent line, on the other hand, can be used either for an associated parent paint of the two-component paint or for a one-component paint.

In another variant of the disclosure, on the other hand, three coating agent lines extend within the applicator. Two of the coating agent lines are here reserved for parent paint or curing agent of a two-component paint. The third coating agent line, on the other hand, is reserved for a one-component paint. This variant of the disclosure thus differs from the variant of the disclosure described above substantially in that a separate coating agent line is provided for the one-component paint, through which neither the parent paint nor the curing agent flows.

A third variant of the disclosure is simplified compared with the variant of the disclosure described at the beginning and has only two coating agent lines, namely a coating agent line for a parent paint of a two-component paint and a second coating agent line for a curing agent of the two-component paint. Thus, unlike in the first variant of the disclosure described at the beginning, it is not provided as an alternative to supply a one-component paint via the coating agent line for the parent paint.

A further variant of the disclosure, on the other hand, provides that four coating agent lines are provided in the applicator, namely two coating agent lines for parent paint and curing agent of a first two-component paint and two further coating agent lines for parent paint and curing agent of a second two-component paint.

FIG. 1 shows a rotary atomiser RZ according to the disclosure, which is guided by a painting robot and is mounted by means of a conventional robot hand axis at the end of a robot arm RA.

In the robot arm RA there is a linear colour changer LCC, which is known, for example, from U.S. Pat. No. 8,881,757 B2 and U.S. Pat. No. 9,782,786 B2. On the outlet side, the linear colour changer LCC is connected via a metering pump PSL to a parent paint connection SL of the rotary atomiser RZ. The metering pump PSL is likewise arranged in the robot arm RA and can be bypassed by a bypass line By1. The function of the metering pump PSL is to meter and convey a parent paint of a two-component paint (2K paint).

There is additionally located in the robot arm RA a solvent valve VSV1 for supplying a solvent for the parent paint, the solvent valve VSV1 being connected on the outlet side to a solvent connection VS1 for the parent paint.

There is further located in the robot arm RA also a metering pump PH for supplying a curing agent for the two-component paint, the metering pump PH being connected on the outlet side to a curing agent connection H of the rotary atomiser RZ.

There is further located in the robot arm RA a solvent valve VHV1 for supplying in a controlled manner a solvent for the curing agent, the solvent valve VHV1 being connected on the outlet side to a solvent connection VH of the rotary atomiser RZ.

The rotary atomiser RZ further comprises a pulsed air connection PL for supplying pulsed air, a return connection RF1 for returning residual material, a return connection RF2 for returning pulsed air and paint foam, and short-flush connections KS1, KS2 for supplying a flushing medium for short flushing of the rotary atomiser.

The parent paint connection SL of the rotary atomiser RZ is connected to a parent paint line, which consists of the line portions L1-L4, which lead to a mixer MIX and finally to a main needle valve HN1, the main needle valve HN1 being connected to an outlet A2 which leads to a bell cup.

In the parent paint line consisting of the line portions L1-L4 there is located, upstream of the mixer MIX, a membrane overpressure valve SLV1, the construction of which will be described in greater detail below. The membrane overpressure valve SLV1 opens automatically, actuated by its own medium, when the pressure of parent paint upstream of the membrane overpressure valve SLV1 exceeds a specific maximum value. When the membrane overpressure valve SLV1 opens, the overpressure can then be dissipated via the mixer MIX and the main needle valve HN1. This prevents an overpressure fault or even the bursting of lines in the line portions L1, L2 upstream of the membrane overpressure valve SLV1.

From the line portion L2 of the parent paint line there branches a return line which is formed by a line portion L5 and opens into the return connection RF1. In the line portion L5 of the return line there is likewise arranged a membrane overpressure valve RFV1, which can be of the same construction as the membrane overpressure valve SLV1. The function of the membrane overpressure valve RFV1 is to permit a pressure reduction if the main needle valve HN1 is defective and no longer opens. In this case, there is a pressure increase in the coating agent line, which consists of the line portions L1-L4. This pressure increase then leads to automatic opening of the membrane overpressure valve RFV1 in good time before an overpressure fault, so that any overpressure in the parent paint line can be reduced through the return line and the return connection RF1.

From the curing agent connection H there leads a curing agent line which consists of the line portions L6, L7. The curing agent line joins the parent paint line upstream of the mixer MIX and downstream of the membrane overpressure valve SLV1. The parent paint and the curing agent are therefore mixed in the mixer MIX.

From the solvent connection VH there leads a solvent line which is formed by a line portion L8. In the line portion L8 of the solvent line there is arranged a solvent valve VHV2 which allows the flow of solvent to be controlled.

From the pulsed air connection PL there leads a pulsed air line which is formed by the line portions L9, L10. In the line portion L9 of the pulsed air line there is arranged a controllable pulsed air valve PLV which controls the flow of pulsed air.

From the other solvent connection VS1 there leads a further solvent line which consists of a line portion L11 and the line portion L10. In the line portion L11 of the solvent line for the parent paint there is arranged a solvent valve VSV2 which is able to control the flow of solvent.

The curing agent valve HV in the curing agent line is likewise in the form of a membrane overpressure valve and therefore likewise opens, actuated by its own medium, when the pressure of the curing agent upstream of the curing agent valve HV exceeds a specific maximum value. The overpressure in the curing agent line can then be reduced via the line portions L7, L4, L3, the membrane overpressure valve SLV1, the membrane overpressure valve RFV1 and the return connection RF1.

In addition, the rotary atomiser RZ also has a further parent paint line which is formed by the line portion L1 already mentioned and a further line portion L12. In the line portion L12 of the further parent paint line there is arranged a parent paint valve SLV2 which leads to a main needle valve HN2. The two main needle valves HN1, HN2 are connected on the outlet side to the outlet A2 and thus to the bell cup. A one-component paint can thereby be applied via the main needle valve HN2. Via the main needle valve HN1, on the other hand, a two-component paint can be applied, which is mixed beforehand in the mixer MIX.

From the line portion L12, upstream of the second main needle valve HN2, there branches a further return line which consists of a line portion L13 which opens into the return connection RF2. In the line portion L13 of the second return line there is arranged a return valve RFV2 which is in the form of a paint stop valve. The return valve RFV2 thus opens, actuated by its own medium, when compressed air or paint foam is present at the inlet of the return valve RFV2. The return valve RFV2 closes, on the other hand, automatically and actuated by its own medium when liquid paint is present at the inlet of the return valve RFV2. The construction of the return valve RFV2 is known per se from the prior art and described, for example, in DE 10 2009 020 064 A1.

From each of the two short-flush connections KS1, KS2 there leads a short-flush line consisting of the line portions L14 and L15, respectively. In each of the two line portions L14, L15 there is arranged a controllable short-flush valve KSV1 and KSV2, respectively, the two short-flush valves KSV1, KSV2 being connected on the outlet side to an outlet A1 for short flushing. The two short-flush lines thus bypass both the two parent paint lines and the curing agent line in a flushing operation and thus permit short flushing, which is known per se from the prior art. Between the outlet of the two short-flush valves KSV1, KSV2, on the one hand, and the outlet of the two main needle valves HN1, HN2, on the other hand, there is arranged a return valve RV.

With regard to the above-described arrangement it should be mentioned that the membrane overpressure valves SFV1, RFV1 and the curing agent valve HV, which is likewise in the form of a membrane overpressure valve, are identified as such by oblique hatching. The return valve RFV2 in the form of a paint stop valve, on the other hand, is identified as the paint stop valve by solid black shading. The main needle valves HN1, HN2, on the other hand, are identified as needle valves by vertical hatching. The remaining valves are identified as conventional needle valves by white shading.

Figure 2:
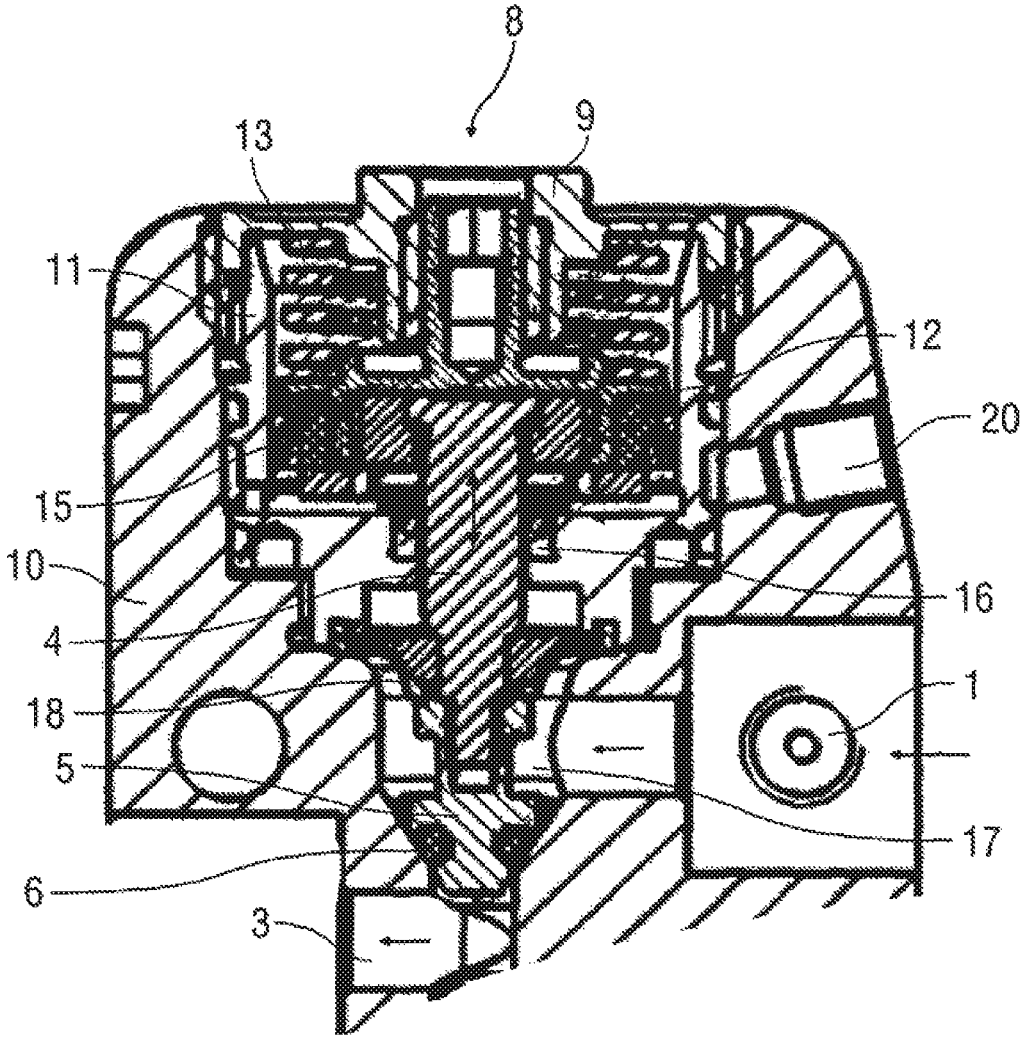
FIG. 2 is a cross-sectional view through an overpressure valve according to the disclosure in a closed position.
Figure 3:
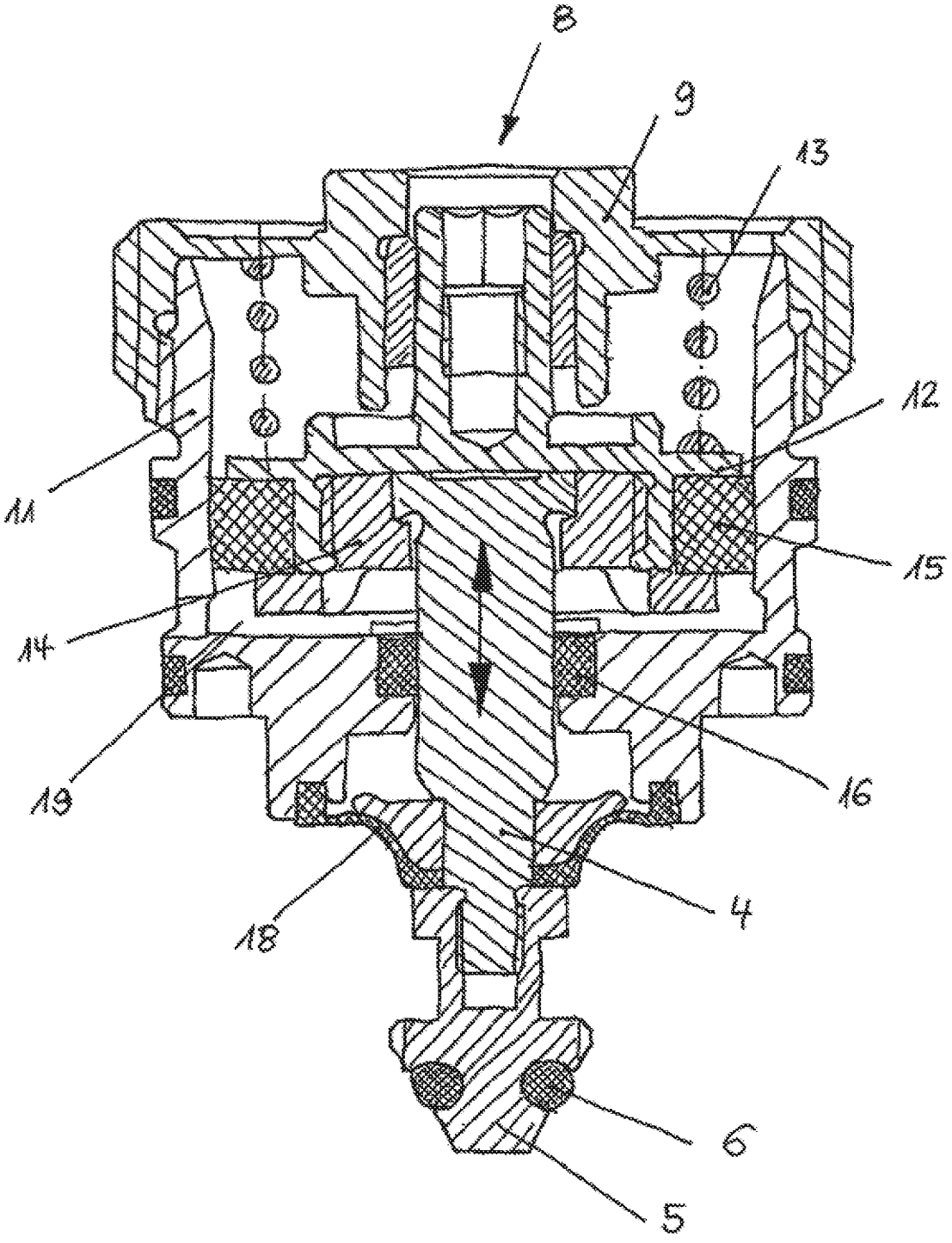
FIG. 3 is a cross-sectional view through a valve drive of the overpressure valve according to FIG. 2.
Figure 4:
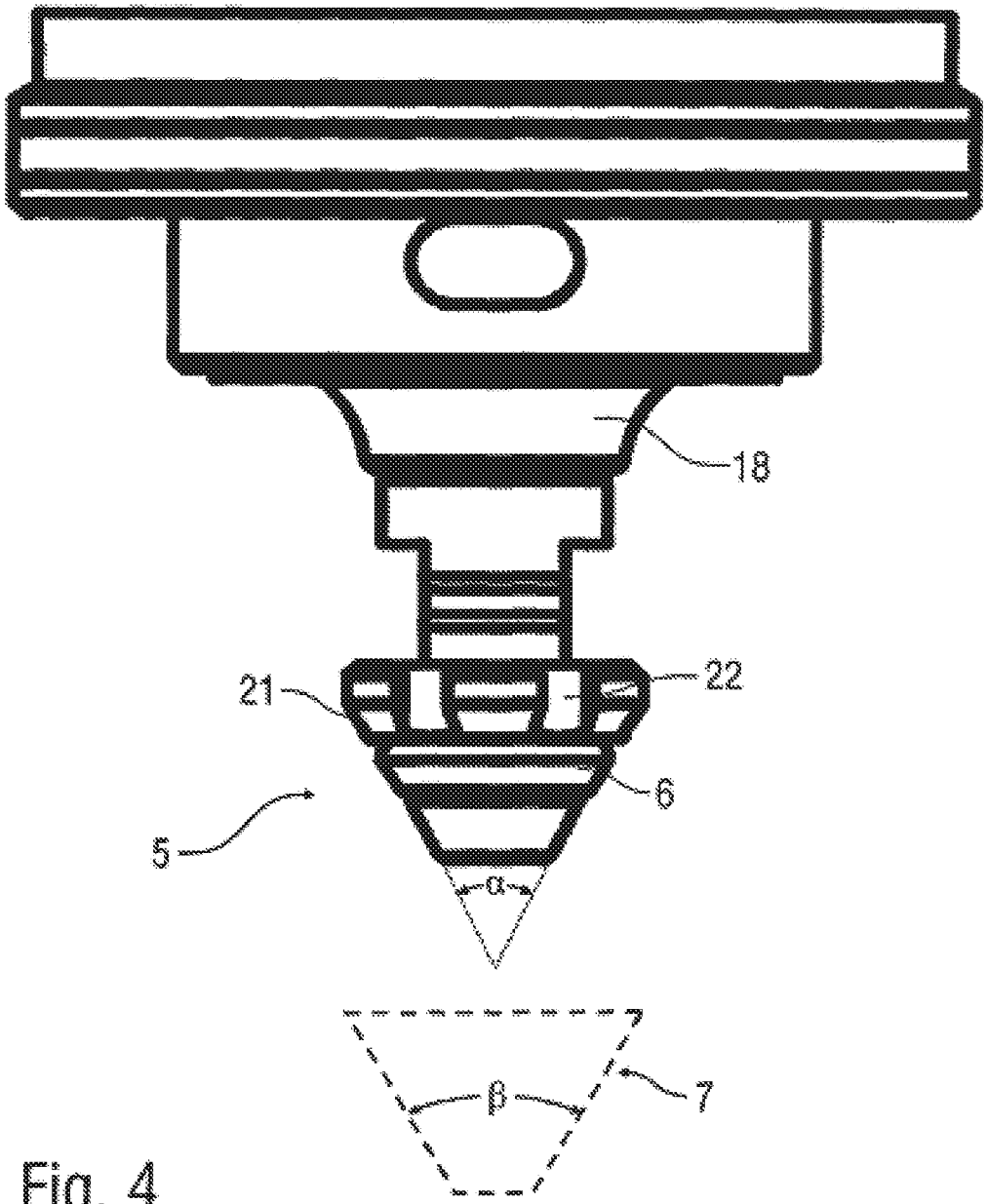
FIG. 4 is a schematic representation of a conical needle head having a conical valve seat.

FIGS. 2-4 show different views of a possible construction of the membrane overpressure valves SLV1, RFV1 and of the curing agent valve HV, which is likewise in the form of a membrane overpressure valve.

The overpressure valve has an inlet 1 for supplying a fluid (e.g. curing agent, parent paint) and an outlet 3 for discharging the coating agent.

The flow of the coating agent from the inlet 1 to the outlet 3 is controlled by a needle valve. The needle valve has a displaceable valve needle 4, a needle head 5 being screwed to the distal end of the valve needle 4. The needle head 5 is made of titanium and tapers conically towards its end, an annular groove being arranged in the conically tapering lateral surface of the needle head 5, in which annular groove a sealing ring 6 of FFKM (perfluoro-elastomers) is installed.

In the closed position according to FIG. 2, the needle head 5 rests in a sealing manner with the sealing ring 6 on a valve seat 7, the valve seat 7 likewise tapering conically and opening into the outlet 3.

In the open position (not shown), on the other hand, the needle head 5 is lifted from the valve seat 7 and thereby enables the flow through the valve seat 7 to the outlet 3.

The closed position and the open position are set by means of a valve drive 8, which is shown in detail in FIG. 3 and operates pneumatically.

The pneumatic valve drive thus has an outer housing insert 9, which is screwed into a housing body 10 of the two-component shut-off valve.

An inner housing insert 11 is in turn screwed into the outer housing insert 9.

A piston 12 is displaceably arranged in the pneumatic valve drive 8, the piston 12 being biased in the direction towards the closed position according to FIG. 2 by a valve spring 13. The valve spring 13 rests on the outer housing insert 9 and pushes at its opposite end against the piston 12 in order to push it into the closed position. The piston 12 is connected to the valve needle 4 via a piston insert 14, so that the piston 12 acts upon the valve needle 4 and thus also upon the needle head.

The piston 12 is surrounded by a sealing ring 15 which is arranged in the annular gap between the piston 12 and the inside wall of the inner housing insert 11 and slides against the inside wall of the inner housing insert 11 when the piston 12 moves.

In addition, a further sealing ring 16 is provided, which rests in a sliding manner on the lateral surface of the displaceable valve needle 4 and thus provides a further seal.

The valve needle 4 runs in part through a valve chamber 17 which during operation is filled with the respective fluid (e.g. curing agent, parent paint).

Between the valve drive 8 and the valve chamber 17 filled with media there is provided a flexible membrane 18 as a sealing element for sealing the valve chamber 17 with respect to the valve drive 8. The flexible membrane 18 is fixed in a sealing manner to the bottom end of the inner housing insert 11 by means of its outer peripheral edge and has in the middle a bore through which the valve needle 4 is guided. The membrane 18 is fixedly connected in a fluid-tight manner to the valve needle 4. On the one hand, the membrane 18 thus performs the movement of displacement of the valve needle 4 between the closed position and the open position. On the other hand, however, the membrane 4 also seals the valve chamber 7 filled with media with respect to the valve drive 8, no sliding movement, as in the case of a sealing ring, being required, so that there is also no risk of the curing agent H, which is of low viscosity and has good creep properties, being able to penetrate the valve drive 8.

The actual drive is effected by means of control air, which can be introduced into a control air chamber 19 beneath the piston 12, the control air in the control air chamber 19 then pushing the piston 12 upwards. The supply of control air into the control air chamber 19 takes place via a control air connection 20.

The control air can be supplied from a conventional 6-bar compressed air network, which is already present in most painting systems. This has the advantage that a separate compressed air supply is not required. The piston 12 has a relatively large effective diameter, so that the control air acting upon the piston generates a relatively great opening force. This opening force, in the case of exposure to compressed air through the control air, is greater by a specific opening force excess than the closing force which is exerted on the piston 12 by the valve spring 13. In this specific embodiment, the opening force excess is in the range of from 57.4 N to 136 N, as compared with an opening force excess of only 15 N in a conventional needle valve. This allows the needle head 5 to "break free" from the valve seat 7 even when the needle head 5 is adhered to the valve seat 7.

It can further be seen from FIG. 4 that the needle head 5 tapers in the direction of flow with a head angle $\lambda=35°-50°$, just as the valve seat 7 also tapers conically in the direction of flow with a seat angle $\beta=35°-50°$.

The conical lateral surface of the needle head 5 upstream of the sealing ring 6 forms a supporting surface 21 which, in the closed position according to FIG. 2, rests on the valve seat 7. The supporting surface 21 forms a stop for the axial movement of the needle head 5 into the closed position. Excessive compression of the sealing ring 6 is thereby prevented, which is beneficial for the life of the sealing ring 6.

The supporting surface 21 is interrupted by a plurality of flushing grooves 22 running axially, which are distributed over the periphery of the needle head 5. In the closed position according to FIG. 2, the flushing grooves 22 allow flushing medium from the inlet 1 also to reach the region downstream of the supporting surface 21.

Figure 5:
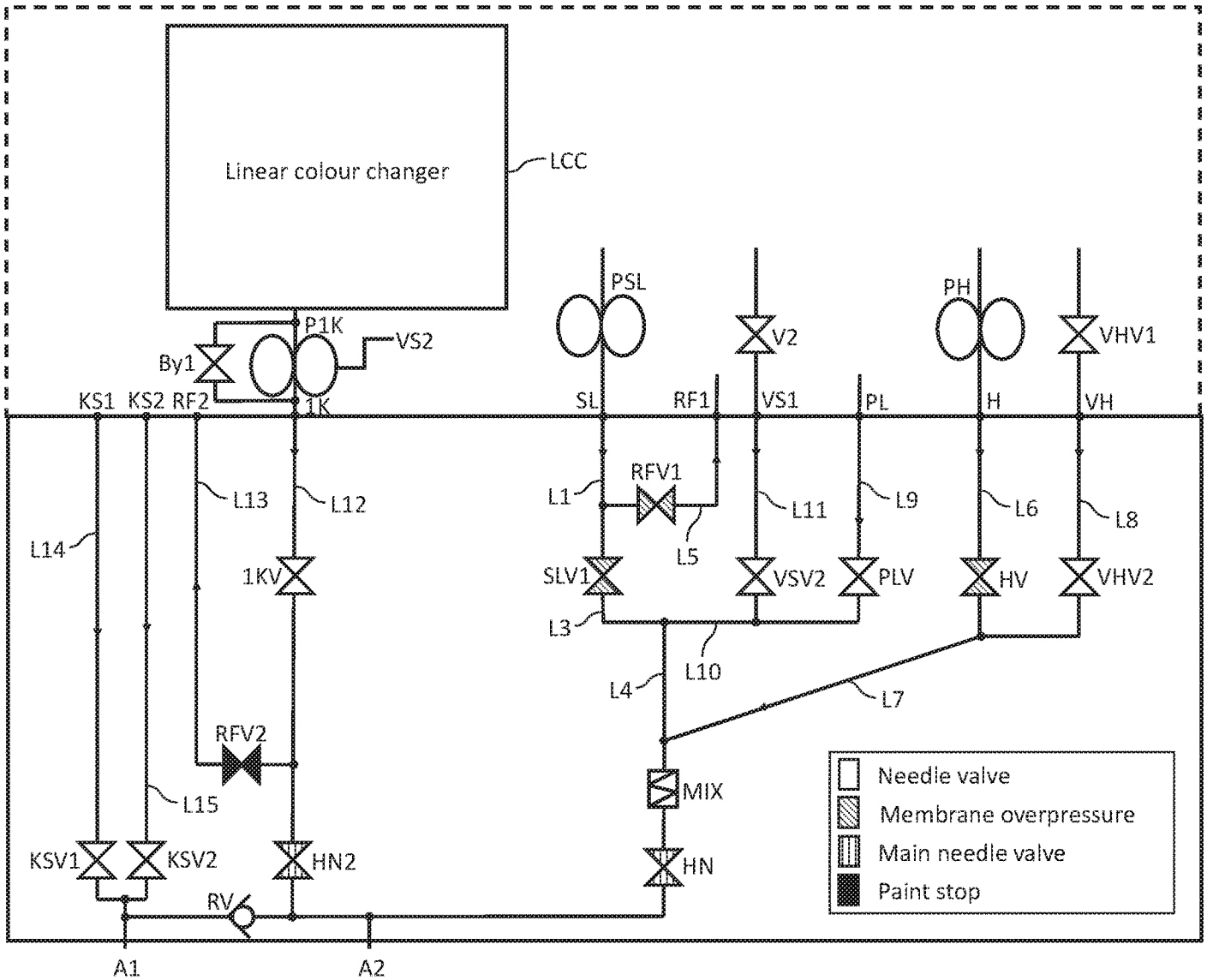
FIG. 5 is a modification of FIG. 1, wherein three coating agent lines extend in the applicator, namely for parent paint, curing agent and, alternatively, a one-component paint.

FIG. 5 shows a modification of FIG. 1 so that, in order to avoid repetition, reference is made to the above description, the same reference numerals being used for corresponding details.

A particular feature of this example is that three coating agent lines extend in the rotary atomiser RZ, namely a coating agent line for a curing agent, a coating agent line for a parent paint and a coating agent line for a one-component paint. The coating agent line for the curing agent consists of the line portions L8 and L7. The coating agent line for the parent paint, on the other hand, consists of the line portions L1, L3 and L4. The separate coating agent line for the one-component paint consists, on the other hand, of the line portion L12. The difference compared with the example according to FIG. 1 is substantially that a separate coating agent line is provided for the one-component paint, whereas in FIG. 1 the coating agent line consisting of the line portions L1, L12 serves either to supply the parent paint or to supply the one-component paint.

Figure 6:
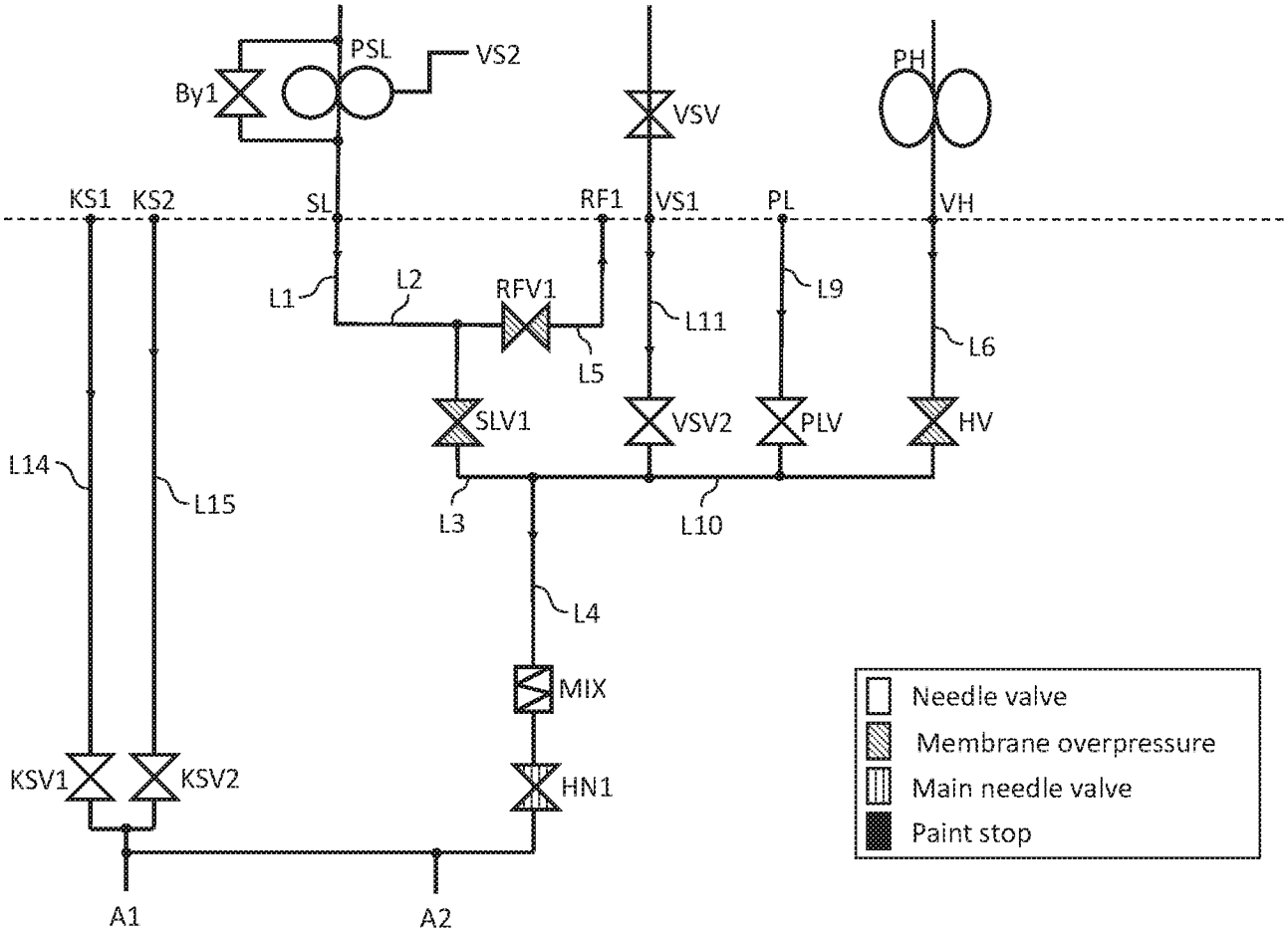
FIG. 6 is a modification of FIG. 1, wherein the parent paint line in the applicator is reserved for the parent paint and does not alternatively serve to supply a one-component paint.

FIG. 6 shows a simplification of FIG. 1 so that, in order to avoid repetition, reference is made to the above description, the same reference numerals being used for corresponding details.

A particular feature of this example is that it is only possible to apply a two-component paint, so that only two coating agent lines are provided for applying parent paint and curing agent. The coating agent line for the curing agent consists of the line portions L6, L10 and L4. The coating agent line for the parent paint, on the other hand, consists of the line portions L1, L2, L3 and L4. By contrast, it is not possible in this example to apply a one-component paint as an alternative, as is possible in FIG. 1.

Figure 7:
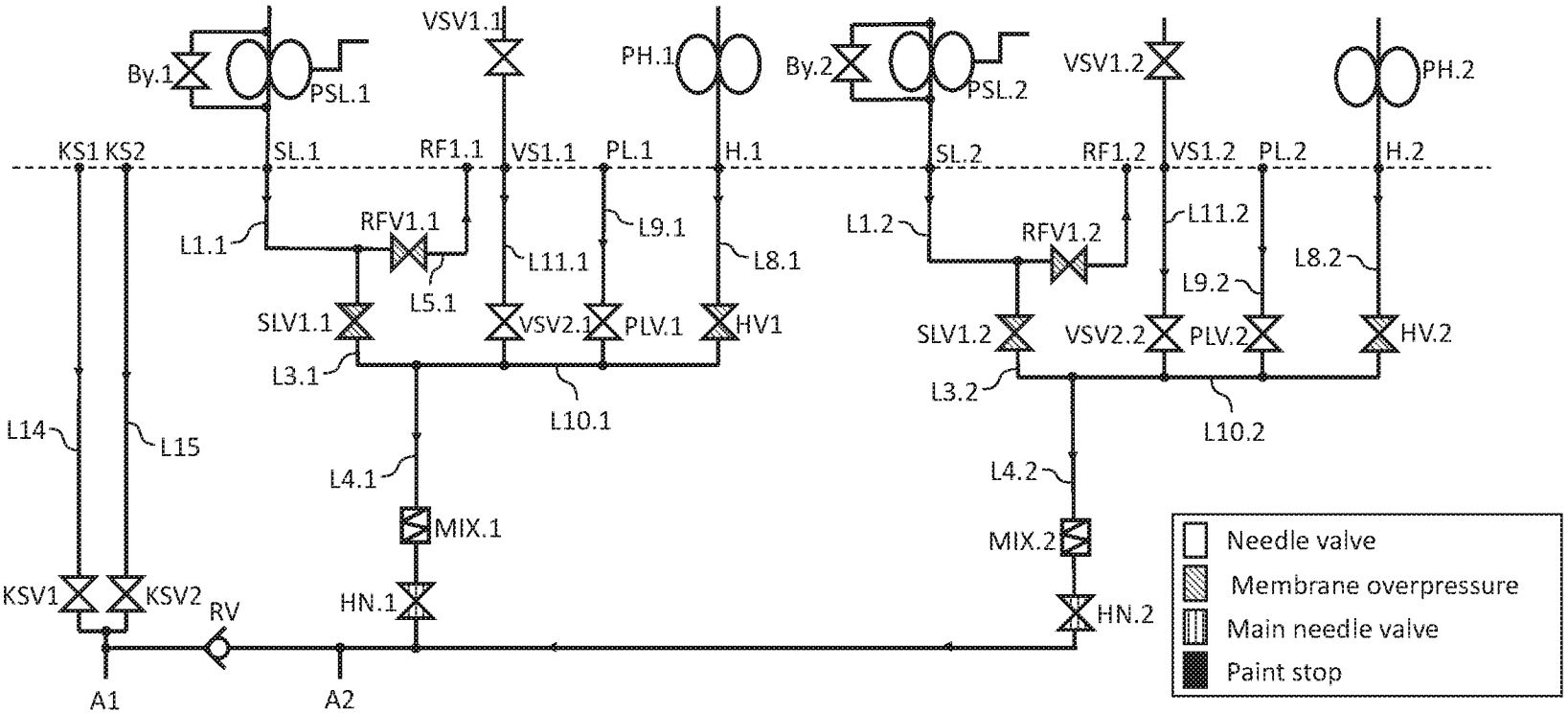
FIG. 7 is a modification of FIG. 1 with four coating agent lines in the applicator for parent paint and curing agent of two different two-component paints.

Finally, FIG. 7 shows a further modification of FIG. 6 so that, in order to avoid repetition, reference is made to the above description.

A particular feature of this example is that a total of four coating agent lines extend in the rotary atomiser, namely for parent paint 1 and curing agent 1 of a first two-component paint and for parent paint 2 and curing agent 2 of a second two-component paint. The fluid schematic diagram according to FIG. 4 is thus substantially parallelised and doubled. The components for the first two-component paint are provided with the added "0.1" as compared with FIG. 6. The components for the second two-component paint, on the other hand, are provided with the added "0.2" compared with FIG. 6. Otherwise, reference may be made in this respect to the above description.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. Application device for applying a coating agent, comprising:

a) a first coating agent connection for supplying a first coating agent, b) a first coating agent line which leads in the application device from the first coating agent connection to an application element and guides the first coating agent, and c) a first valve which is arranged in the first coating agent line and controls the flow of the first coating agent, the first valve being controllable by a first control signal, d) wherein there is arranged in the first coating agent line an own-medium-actuated first overpressure valve which, in order to avoid an overpressure fault, opens automatically when the pressure upstream of the first overpressure valve exceeds a specific maximum pressure, e) wherein the first valve is arranged in the first coating agent line between the first overpressure valve and the application element, f) a first return connection for returning fluids into a first return system, g) a first return line branches from the first coating agent line upstream of the first overpressure valve, h) the first return line opens into the first return connection, and i) in the first return line there is arranged a third overpressure valve which is own-medium-actuated and opens automatically when the pressure in the first return line upstream of the third overpressure valve exceeds a specific maximum pressure.

2. Application device according to claim 1, wherein a) the application device has a second coating agent connection for supplying a second coating agent, b) a second coating agent line leads from the second coating agent connection, c) in the second coating agent line there is arranged a second overpressure valve which is own-medium-actuated and opens automatically when the pressure upstream of the second overpressure valve exceeds a specific maximum pressure, and d) the second coating agent line joins the first coating agent line upstream of the first valve.

3. Application device according to claim 2, wherein in the first coating agent line, between the point at which the second coating agent line joins and the first valve, there is arranged a first mixer which mixes the parent pant with the curing agent to form the two-component paint.

4. Application device according to claim 3, wherein the first mixer is a static mixer.

5. Application device according to claim 3, wherein a) the first coating agent is a parent paint of a two-component paint, and b) the second coating agent is a curing agent of the two-component paint.

6. Application device according to claim 5, wherein a) the parent paint of the two-component paint is supplied via the first coating agent connection, b) the curing agent of the two-component paint is supplied via the second coating agent connection, c) the first coating agent line for the parent paint and the second coating agent line for the curing agent open into the first mixer, d) the first valve is arranged downstream of the first mixer, e) the application device has a third coating agent connection for supplying a one-component paint, f) the third coating agent line leads from the third coating agent connection, g) the second valve is arranged in the third coating agent line, and h) the first valve and the second valve are brought together on the outlet side.

7. Application device according to claim 2, wherein a) there is provided a third coating agent line which leads from the first coating agent connector;

b) in the third coating agent line there is arranged a second valve, c) the first valve and the second valve are brought together on the outlet side and lead to the application element.

8. Application device according to claim 7, wherein a) the application device has a second return connection for returning fluids into a second return system, b) a second return line branches from the third coating agent line upstream of the second valve, c) the second return line opens into the second return connection, and d) a return valve is arranged in the second return line, e) the return valve is own-medium-actuated, f) the return valve distinguishes between liquid coating agent, on the one hand, and compressed air or foam, on the other hand, f1) wherein the return valve opens when compressed air or foam is present at the inlet of the return valve, f2) whereas the return valve closes when liquid, coating agent is present at the inlet of the return valve.

9. Application device according to claim 1, wherein a) the application device has a first solvent connection for supplying a first solvent b) a first solvent line branches from the first solvent connection, c) the first solvent line joins the first coating agent line between the first overpressure valve and the first valve, and d) ire the first solvent line there is arranged a first solvent valve.

10. Application device according to claim 9, wherein a) the application device has a second solvent connection for supplying a second solvent, b) a second solvent line leads from the second solvent connection, c) the second solvent line opens into the first coating agent line between the first overpressure valve and the first valve, and d) there is arranged in the second solvent line a second solvent valve.

11. Application device according to claim 1, wherein a) the application device has a pulsed air connection for supplying pulsed air, b) a pulsed air line leads from the pulsed air connection, c) the pulsed air line joins the first coating agent line between the first overpressure valve and the first valve, and d) there is arranged in the pulsed air line a pulsed air valve.

12. Application device according to claim 1, wherein a) a first parent paint of a first two-component paint is supplied via the first coating agent connection, b) a first curing agent of the first two-component paint is supplied via the second coating agent connection, c) the first coating agent line for the first parent paint and the second coating agent line for the first curing agent open into the first mixer, d) the first valve is arranged downstream of the first mixer, e) the application device has the third coating agent connection for supplying a second parent paint of a second two-component paint, f) the third coating agent line for the second parent paint leads from the third coating agent connection, g) the application device has a fourth coating agent connection for supplying a second curing agent of the second two-component paint, h) a fourth coating agent line leads from the fourth coating agent connection for the second curing agent, i) the third coating agent line and the fourth coating agent line open into a second mixer, which mixes the second parent paint with the second curing agent, j) the second valve is arranged downstream of the second mixer, and k) the first main valve and the second valve are brought together on the outlet side.

13. Application device for applying a coating agent, comprising:

a) a first coating agent connection for supplying a first coating agent, b) a first coating agent line which leads in the application device from the first coating agent connection to an application element and guides the first coating agent, and c) a first valve which is arranged in the first coating agent line and controls the flow of the first coating agent, the first valve being controllable by a first control signal, d) wherein there is arranged in the first coating agent line an own-medium-actuated first overpressure valve which, in order to avoid an overpressure fault, opens automatically when the pressure upstream of the first overpressure valve exceeds a specific maximum pressure, e) wherein the first valve is arranged in the first coating agent line between the first overpressure valve and the application element, f) a second coating agent connection for supplying a second coating agent, g) a second coating agent line leads from the second coating agent connection, h) in the second coating agent line there is arranged a second overpressure valve which is own-medium-actuated and opens automatically when the pressure upstream of the second overpressure valve exceeds a specific maximum pressure, i) the second coating agent line joins the first coating agent line upstream of the first main valve, j) wherein there is provided a third coating agent line which leads from the first coating agent connection, k) in the third coating agent line there is arranged a second valve, l) the first valve and the second valve are brought together on the outlet side and lead to the application element.

14. Application device according to claim 13, wherein in the first coating agent line, between the point at which the second coating agent line joins and the first ma44-valve, there is arranged a first mixer which mixes the parent paint with the curing agent to form the two-component paint.

15. Application device according to claim 13, wherein a) the application device has a second return connection for returning fluids into a second return system, b) a second return line branches from the third coating agent line upstream of the second valve, c) the second return line opens into the second return connection, and d) a return valve is arranged in the second return line, e) the return valve is own-medium-actuated, f) the return valve distinguishes between liquid coating agent, on the one hand, and compressed air or foam, on the other hand, f1) wherein the return valve opens when compressed air or foam is present at the inlet of the return valve, f2) whereas the return valve closes when liquid coating agent is present at the inlet of the return valve.

16. Application device for applying a coating agent, comprising:

a) a first coating agent connection for supplying a first coating agent, b) a first coating agent line which leads in the application device from the first coating agent connection to an application element and guides the first coating agent, and c) a first valve which is arranged in the first coating agent line and controls the flow of the first coating agent, the first valve being controllable by a first control signal, d) wherein there is arranged in the first coating agent line an own-medium-actuated first overpressure valve which, in order to avoid an overpressure fault, opens automatically when the pressure upstream of the first overpressure valve exceeds a specific maximum pressure, e) wherein the first valve is arranged in the first coating agent line, between the first overpressure valve and the application element, f) a second coating agent connection for supplying a second coating agent, g) a second coating agent line leads from the second coating agent connection, h) in the second coating agent line there is arranged a second overpressure valve which is own-medium-actuated and opens automatically when the pressure upstream of the second overpressure valve exceeds a specific maximum pressure, i) the second coating agent line joins the first coating agent line upstream of the first valve, j) wherein in the first coating agent line, between the point at which the second coating agent line joins and the first valve, there is arranged a first mixer which mixes the parent paint with the curing agent to form the two-component paint, k) wherein the first coating agent is a parent paint of a two-component paint, l) the second coating agent is a curing agent of the two-component paint, m) wherein the parent paint of the two-component paint is supplied via the first coating agent connection, n) the curing agent of the two-component paint is supplied via the second coating agent connection, o) the first coating agent line for the parent paint and the second coating agent line for the curing agent open into the first mixer, p) the first valve is arranged downstream of the first mixer, q) the application device has a third coating agent connection for supplying a one-component paint, r) the third coating agent line leads from the third coating agent connection, s) the second valve is arranged in the third coating agent line, and t) the first valve and the second valve are brought together on the outlet side.

17. Application device for applying a coating agent, comprising:

a) a first coating agent connection for supplying a first coating agent, b) a first coating agent line which leads in the application device from the first coating agent connection and guides the first coating agent, and c) a first valve which is arranged in the first coating agent line and controls the flow of the first coating agent, the first valve being controllable by a first control signal, d) wherein there is arranged in the first coating agent line an own-medium-actuated first overpressure valve which, in order to avoid an overpressure fault, opens automatically when the pressure upstream of the first overpressure valve exceeds a specific maximum pressure, e) wherein a first parent paint of a first two-component paint is supplied via the first coating agent connection, f) a first curing agent of the first two-component paint is supplied via the second coating agent connection, q) the first coating agent line for the first parent paint and the second coating agent line for the first curing agent open into the first mixer, h) the first valve is arranged downstream of the first mixer, i) the application device has the third coating agent connection for supplying a second parent paint of a second two-component paint, j) the third coating agent line for the second parent paint leads from the third coating agent connection, k) the application device has a fourth coating agent connection for supplying a second curing agent of the second two-component paint, l) a fourth coating agent line leads from the fourth coating agent connection for the second curing agent, m) the third coating agent line and the fourth coating agent line open into a second mixer, which mixes the second parent paint with the second curing agent, n) the second valve is arranged downstream of the second mixer, and o) the first valve and the second are brought together on the outlet side.

* * * * *